United States Patent [19]

Deffayet et al.

[11] 4,075,946

[45] Feb. 28, 1978

[54] ARMOR PIERCING PROJECTILE

[75] Inventors: Jean Deffayet; Etienne Lamarque, both of Paris, France

[73] Assignee: Thomson-CSF, Paris, France

[21] Appl. No.: 763,205

[22] Filed: Jan. 27, 1977

[30] Foreign Application Priority Data

Jan. 30, 1976 France ..... 76 02590

[51] Int. Cl.[2] ..... F42B 11/14

[52] U.S. Cl. ..... 102/52; 102/92.1

[58] Field of Search ..... 102/52, 92.1–92.6

[56] References Cited

U.S. PATENT DOCUMENTS

| | | | |
|---|---|---|---|
| 807,375 | 12/1905 | Haase | 102/52 |
| 1,130,446 | 3/1915 | Taylor | 102/52 |
| 1,179,686 | 4/1916 | Kampen et al. | 102/52 |
| 1,407,532 | 2/1922 | Hadfield et al. | 102/52 |
| 1,502,925 | 7/1924 | Stone | 102/52 |
| 3,620,167 | 11/1971 | Romer et al. | 102/93 |
| 3,935,817 | 2/1976 | Riparbelle | 102/52 |

FOREIGN PATENT DOCUMENTS

| | | | |
|---|---|---|---|
| 1,213,894 | 3/1977 | United Kingdom | 102/52 |

*Primary Examiner*—Harold Tudor
*Attorney, Agent, or Firm*—Edwin E. Greigg

[57] ABSTRACT

The invention relates to improvements in armor-piercing projectiles formed in two component units, a first unit being a hollow envelope or shell, which is impact-resistant, and a second, being a ballast of a high specific weight, which is mounted in the hollow cavity of the envelope. The ballast improves the piercing performance of the projectile without detracting from impact resistance.

8 Claims, 4 Drawing Figures

3
11
1
2
21
4
31

(a)
31
21
11
e
1
2
4

3
β
(b)
21
11
R1
R2
13
12
14
α
β

ARMOR PIERCING PROJECTILE

BACKGROUND OF THE INVENTION

The present invention relates to armor-piercing projectiles and more specifically to an armor-piercing body intended to be fitted on very long projectiles .

An armor-piercing projectile is a round intended to pierce the sheet plating which provides protection for a wide variety of vehicles or shelters. These sheet plates, called armor-plating, are made of a material such as steel, suitably alloyed and treated. The primary effect sought in armor-piercing projectiles is the penetration of the armor-plating; their destructive power is supplied by secondary effects, such as the ejection of material inside the shelter or by combination with the projectile of elements able to produce complementary effects such as fires.

Armor-piercing munition can be divided into two main classes;

- armor-piercing projectiles, characterized by a length having an aspect ratio of three to five times the diameter, fired by a cannon with a rifled bore, which provides gyroscopic stability during the trajectory;
- armor-piercing arrows, characterized by a length having an aspect ratio of ten to fifteen times the diameter, fired or ejected from a cannon with a smooth bore, stability during the trajectory being obtained by the addition of stabilizer fins.

The invention concerns the latter class more particularly.

An armor-piercing arrow generally has three elements:

- the arrow body which has a very high mechanical resistance,
- the stabilizer fins which are usually provided at the rear of the body,
- an aerodynamic cap which covers the front part of the body.

The theory of armor-piercing projectiles is fairly well established. In particular, it is known that the main parameters governing the perforating power of the weapon are:

- the speed, the mass and the caliber of the arrow body at the instant of impact on the armor-plating,
- the mechanical resistance of the arrow body to the shock and penetration.

As a result, for a given arrow body speed upon impact and a given caliber, the perforating power thereof can be increased by increasing the mass of the body.

If the projectile caliber is fixed, a known means of increasing that mass is to alter the aspect ratio and simultaneously to choose a material which combines the required mechanical qualities with a high density. These considerations are not independent; in particular, increasing the length calls for an increase in the mechanical resistance qualities.

The application of the above considerations becomes difficult when the operational conditions of firing are taken into account. It is desirable that the arrow body piercing power remain satisfactory over a wide range of incident angles on impact. In particular, the mechanical forces developed during the armor-piercing phase, especially at high incident angles, limit the maximum aspect ratio to values between 12 and 15 times the diameter.

The only variable parameter available, with speed, caliber, and aspect ratio fixed, is the specific weight or mass of the material used for the construction of the body. Unfortunately, those materials with a high specific weight do not have intrinsically the mechanical characteristics required and necessary to prevent the break-up or buckling of the arrow during armor-piercing. To improve the mechanical resistance of certain high density materials, it is known that the arrow body thus formed can be subjected to certain treatment. These operations are relatively critical and complex and, as a result, lead to high production costs for the projectile.

OBJECTS AND SUMMARY OF THE INVENTION

The principal object of the present invention is to remedy the disadvantages inherent in the use of a monolithic piercing body and to produce simply a composite piercing body with a high performance whose production cost is low.

Another object of the present invention is to provide a piercing body consisting of two elements: an envelope which can resist the mechanical impact force of armor-piercing and a ballast made of high specific weight material placed inside the envelope.

Still another object of the present invention allows for the leading end of the envelope to form the piercing head and the trailing end to receive stabilizer fins.

Other objects and advantages will appear in the following description, which taken with the drawings, presents in a non-limiting explanation, one embodiment of the invention which is especially adapted to a piercing arrow with a high aspect ratio.

BRIEF DESCRIPTION OF THE DRAWINGS

FIG. 2(*b*) shows details of the envelope percussion head.

DESCRIPTION OF THE PREFERRED EMBODIMENT

The arrow is formed by the composite piercing body, which is the subject of the invention, and by the auxiliary elements, the aerodynamic cap and the stabilizer fins, which are already known in the art.

Figure 1:
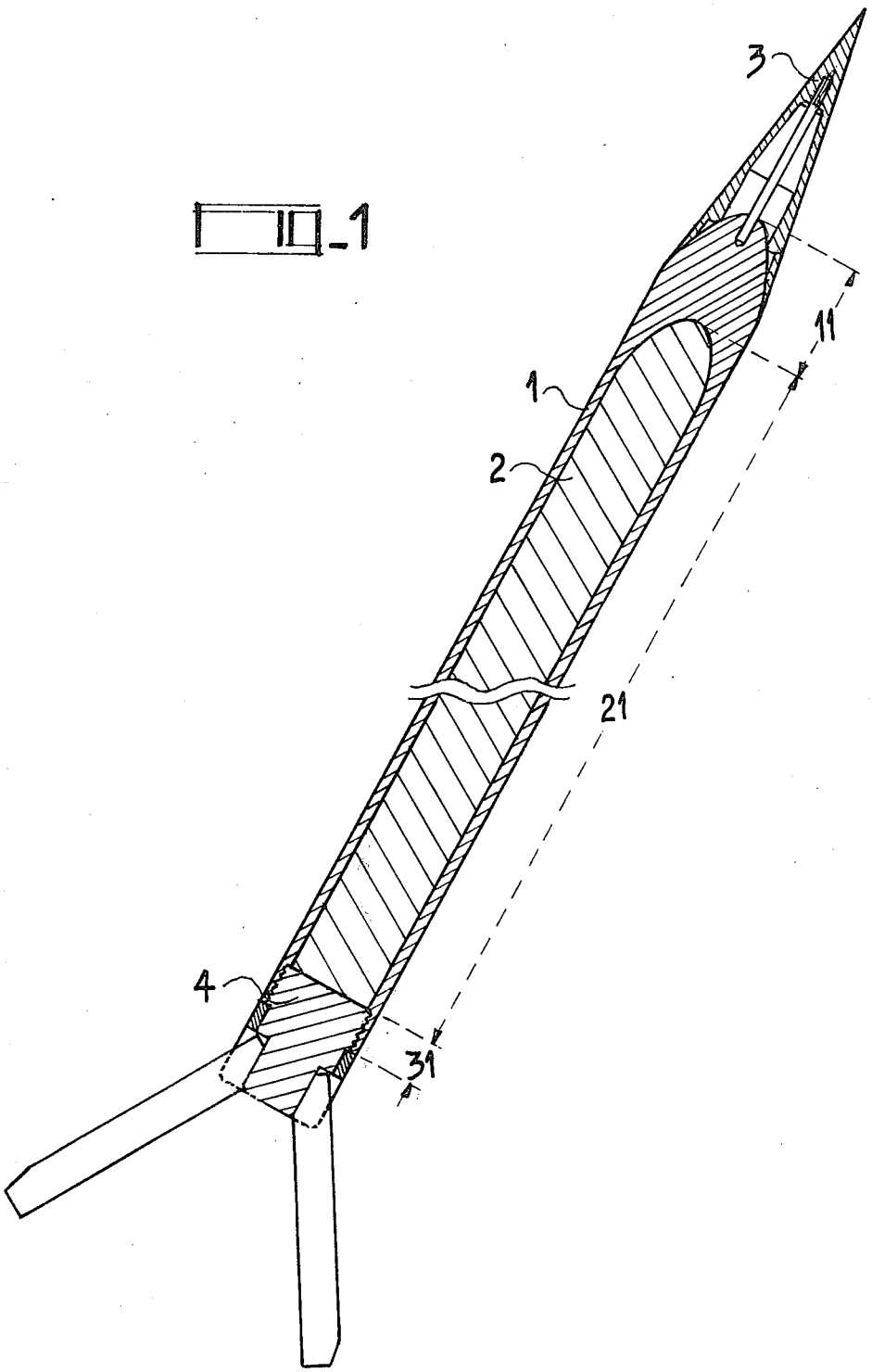
FIG. 1 shows a piercing arrow with stabilizer fins constructed in accordance with the invention.

As shown in FIG. 1, the arrow body consists of two main elements:

- an envelope 1, made of a material with a high mechanical resistance, such as a suitably alloyed and treated steel,
- a ballast 2, made of high specific weight material, such as tungsten.

The envelope 1 has a circular transverse cross section and comprises three sectional areas:

a. The percussion head 11 which forms the piercing head. It is of very strong construction, its axial thickness being of the order of the projectile diameter.

b. The central section 21 which forms the envelope proper and contains the ballast. It takes the form of a hollow cylinder, its diameter being equal to the projectile caliber, while the wall thickness is about one tenth of the caliber.

c. The trailing section 31 which forms a receptacle intended to receive the stabilizer fins 4, which section is used to retain the ballast in the cavity within the envelope.

Depending on the projectile launch tube design, the stabilizer fins are either of a fixed type or of a movable type, which can be opened out; and these designs are known in the art.

The piercing head is fitted with an aerodynamic nose cone whose principal purpose is to reduce aerodynamic drag during the flight trajectory. The nose cone, for example, is made of a material with low resistance to shock, such as a light alloy.

The ballast 2 is made of high specific weight material, the value thereof being greater than 12. Its shape is complementally formed to fit the internal configuration of the cavity of the envelope.

As an example, a piercing arrow of 20 mm caliber with an aspect ratio on the order of 15 calibers (measured from the tip of the nose cone to the end of the stabilizer fins) and an impact speed of about 1200 m/s, allows for the following performance characteristics:

The cylindrical envelope is machined in a steel such as 30 NCD 16 which, when suitably treated, gives the following performance:

elastic limit E = 125 hbar
resistance to breakage R = 140 hbar
coefficient of elongation A = 13.5%
resilience KUF = 6.5 kgm/cm$^2$
specific weight: about 7.8
envelope mass: about 150 gm The ballast is made from a high specific weight material such as tungsten or uranium. Its diameter is about 16 mm and its length 170 mm, which gives a weight of 550 gm. Its mechanical performance characteristics in the case of the tungsten alloy chosen are:

resistance to breakage R = 90 hbar
coefficient of elongation A = 9%
specific weight: about 17.5

The ballast is friction-fitted inside the envelope. The base of the stabilizer fins, when it is fitted on the envelope end, retains the ballast therein.

A piercing arrow with stabilizer fins, which is the subject of the invention, having the above given characteristics, can pierce armor-plating, with a depth of greater than 100 mm at incident angles of more than 60°.

The invention comprehends that the dimensions, weights and materials may differ from those given above as a non-limiting example in the present description. The object of the invention consists of combining the impact resistance of a suitably alloyed and treated steel with the weight advantage of a high specific weight material, by making the piercing body of a projectile in the shape of an envelope which can withstand the impact and the forces generated by piercing, and ballasting the interior cavity of this envelope with a material which is dense but lacks the requisite impact resistance.

The impact-resistant envelope of the projectile just described, has a conical point or percussion head, whose end takes on a hemispherical shape, centrally apertured at its extremity, for a nose cone support means, as shown in FIG. 1.

The results of experimental firings, carried out with projectiles constructed according to the invention and in the preceding description, have illustrated the importance of the percussion head shape, in particular the internal profile of the jointing area between the percussion head 11 and the hollow cylindrical cavity. It has also proven that it is advisable to avoid any additional machining in this area, such as for the aperture for the nose cone support means, as this may weaken the mechanical impact resistance of the conical point.

In accordance with one characteristic of the invention, the end of the percussion head is constructed and designed to cling to the armor-plating on impact.

In accordance with another characteristic of the invention, the terminus 12 of the percussion head is truncated, so that the aerodynamic cap can be attached without machining that might otherwise weaken and reduce the mechanical impact resistance of the envelope head.

In accordance with still another characteristic, the internal jointing area between the percussion head and the hollow cylindrical cavity of the envelope is made progressive.

Figures 2, 3:
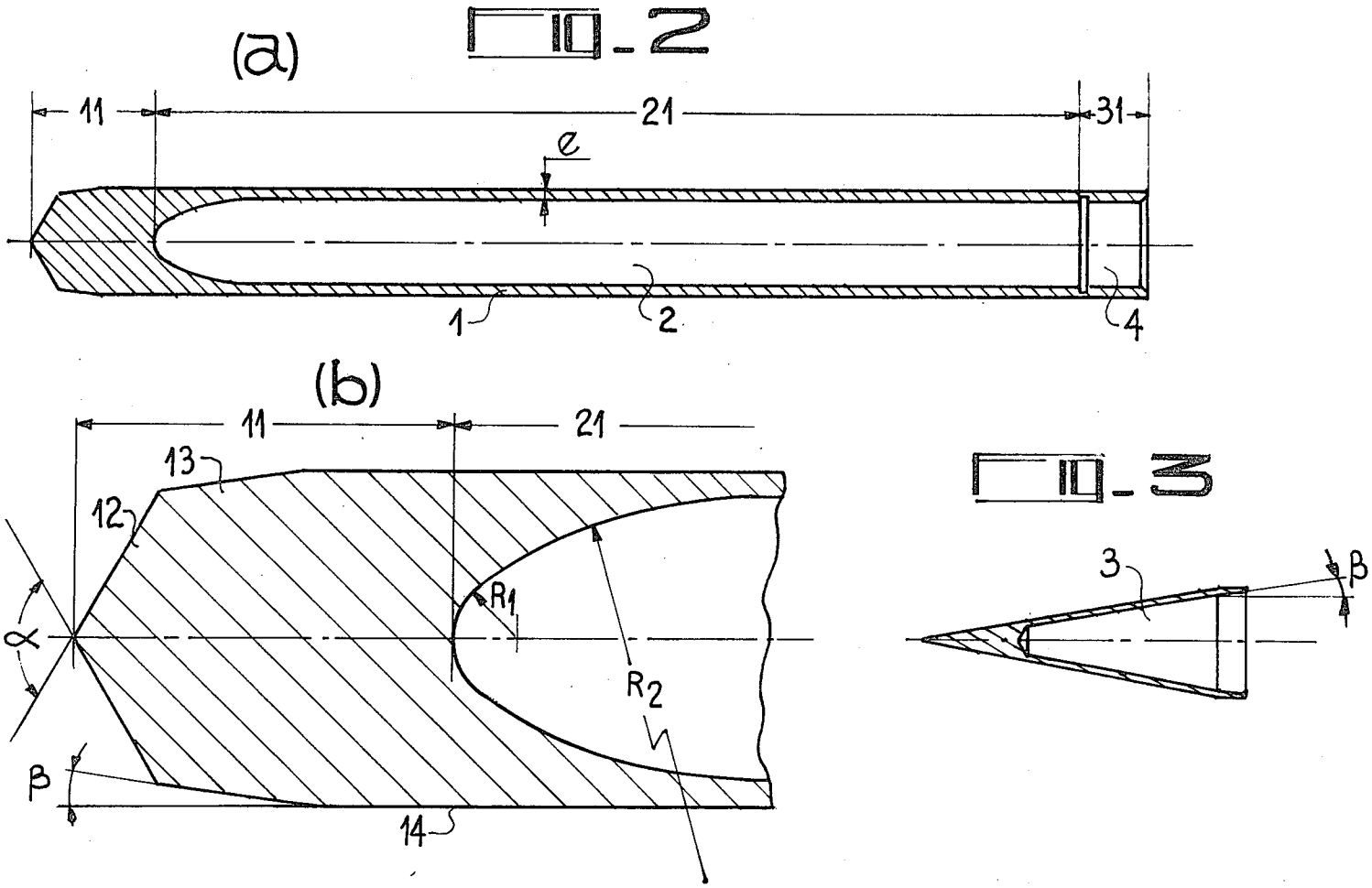
FIG. 2(*a*) shows a sectional view of the piercing body per se.
FIG. 3 shows a sectional view of the aerodynamic nose cone.

In FIG. 2(*a*), the projectile body is shown in a longitudinal section and in FIG. 2(*b*), details of the percussion head construction are shown.

The percussion head 11 is shown in FIG. 2(*b*). It has a terminus 12 with an included angle $\alpha$ of about 120°, a shoulder 13 tapering at an angle $\beta$ of a few degrees with respect to the portion 14 which is cylindrical, its diameter being equal to the projectile caliber.

Internally, the jointing area between the percussion head 11 and the central section of the envelope 21 is made progressive. This area may be formed, for example, by a radius $R_2$ which radius is of a length one or two times the projectile caliber, decreasing progressively into the percussion head with a radius $R_1$ of a fraction of the caliber. This is best shown in FIG. 2(*b*).

The envelope construction material may be a steel alloy, such as 60 NCDV 11 which, after machining, may be subjected to a quenching operation, followed by a tempering treatment, so that its hardness varies progressively along the envelope axis, the percussion head being the hardest. The tip 12 of the percussion head 11 may be slightly blunted by milling.

FIG. 3 shows a view of a longitudinal section of the nose cone 3 which fits on the percussion head shoulder 13. Its profile is designed to reduce aerodynamic drag; usually it has a length of 2 to 4 calibers. The cone is of a material of very little impact resistance, such as an aluminum alloy, and the thickness of its walls is on the order of tenths of a millimeter.

The ballast is of a high specific weight material, preferably higher than 12. Its shape is complemental to the shape of the envelope cavity 2. This ballast is friction-fitted inside the cavity. It is held in place by a cap mounted on the trailing section 31 of the envelope.

A round, whose body is made in accordance with the invention, can pierce armor-plating several centimeters thick at an incident angle of 70°.

The present invention is applicable to all piercing projectiles and, in particular, to projectiles fired from cannons and sub-projectiles ejected from rockets.

What is claimed is:

1. An armor-piercing projectile comprising an outer steel envelope having three portions: a conically tapering forward portion which defines a solid impact head having a leading edge contour suitable for piercing armor on impact as well as providing means for attaching an overlying nose cone thereto, a substantially cylindrical medial portion contiguous with said forward portion having a hollow area running its entire extent, said hollow area being filled with a ballast having a density greater than the density of said steel envelope, and a cylindrical trailing portion contiguous with said medial portion, but remote from said forward portion provided with means to retain said ballast in said medial portion, and further provided with means for attaching stabilizing fins thereto.

2. An armor-piercing projectile as claimed in claim 1, in which the said ballast is a tungsten alloy, having a specific weight greater than 12.

3. An armor-piercing projectile as claimed in claim 2, in which the conical taper of said leading edge of said forward portion is such that an enclosed angle defined by an axial sectional view of said leading edge is substantially 120°.

4. An armor-piercing projectile as claimed in claim 1, in which said envelope comprises a mechanical body of 60 NCDV 11 steel.

5. An armor-piercing projectile as claimed in claim 1, in which said nose cone is formed from an aluminum alloy and serves to provide a streamlined contour for stabilizing the flight of the projectile.

6. An armor-piercing projectile as claimed in claim 1, in which said means to retain said ballast and said means for attaching stabilizing fins comprises a plug member threadedably disposed within said trailing portion which has two extremities, a forward extremity which abuts and retains said ballast, and a rearward extremity upon which said stabilizer fins are attached.

7. An armor-piercing projectile as claimed in claim 1, in which said elongated hollow envelope comprises a machined body of 30 NCD 16 steel.

8. An armor-piercing projectile as claimed in claim 1, in which the ballast consists of uranium.

* * * * *